US006026931A

United States Patent [19]

Swiderski

[11] Patent Number: 6,026,931

[45] Date of Patent: Feb. 22, 2000

[54] SUPPORT FRAME ASSEMBLY

[75] Inventor: Paul R. Swiderski, Scott County, Ky.

[73] Assignee: Emerson Electric Co., St. Louis, Mo.

[21] Appl. No.: 09/179,054

[22] Filed: Oct. 26, 1998

[51] Int. Cl.[7] ..... E06C 5/00

[52] U.S. Cl. ..... 182/15; 182/17

[58] Field of Search ..... 182/12–17; 280/9; 16/44

[56] References Cited

U.S. PATENT DOCUMENTS

| | | | |
|---|---|---|---|
| 1,759,424 | 5/1930 | Strauss | 182/15 |
| 3,291,254 | 12/1966 | Mihalik | 182/15 |
| 4,624,341 | 11/1986 | Lee | 182/15 |
| 5,653,306 | 8/1997 | Bendickson | 182/15 |

FOREIGN PATENT DOCUMENTS

| | | | |
|---|---|---|---|
| 1034060 | 6/1966 | United Kingdom | 182/17 |

*Primary Examiner*—Alvin Chin-Shue

*Attorney, Agent, or Firm*—Polster, Lieder, Woodruff & Lucchesi, L.C.

[57] ABSTRACT

A support frame assembly including at least one pair of generally vertical spaced uprights joined together by transversely extending structural members and having caster wheel support members for supporting a rotatably mounted caster wheel mounted axle and a pedal actuatable lever engaging the axle to allow selective movement of the caster wheel mounted axle between "mobile" and "use" mode conditions—the invention further including a joined second pair of generally vertical spaced uprights each having a caster wheel support member for yieldably supporting a caster wheel arrangement for selective movement between "mobile" and "use" modes.

20 Claims, 7 Drawing Sheets

SUPPORT FRAME ASSEMBLY

BACKGROUND OF THE INVENTION

The present invention relates to support frame assemblies and more particularly to a unique arrangement for readily adjusting various types of support frame assemblies between "mobile" and "use" modes—particularly step ladder and platform assemblies.

Mobile support frame structures incorporating various mechanical assemblies for adjusting such support frame structures between "mobile" and "use" modes are generally well known in support frame art. In this regard, attention is directed to U.S. Pat. No. 5,653,306, issued to R. B. Bendickson et al on Aug. 5, 1997 and to U.S. Pat. No. 5,791,434, issued on August 11 to Paul R. Swiderski and to the several patent references cited therein. These aforementioned patents recognized and resolved many of the comparatively complex constructions, assemblies, uses, and maintenance problems of previous assemblies as does the unique structural arrangement of the present invention described herein, the present invention further providing a mobile ladder and platform structural arrangement which further simplifies and minimizes the required operational pressures to adjust various types of structural support frames between alternative "mobile" and "use" modes. The present invention accomplishes its unique arrangement in a straightforward and economical manner, requiring a minimum of parts and a minimum of manufacturing, assembling, operating and maintenance steps to accomplish the desired adjusted positions for various types of support frame members and particularly for step ladder structural frame assemblies.

Various other features of the present invention will become obvious to one skilled in the art upon reading the disclosure set forth herein.

BRIEF SUMMARY OF THE INVENTION

More particularly the present invention provides a support frame structure which can be utilized in various structural support assemblies including single and extensible ladder frames, step ladders and platform support frames, the support frame structure including at least one pair of generally vertically extending spaced uprights connected by transversely extending cross-beam members and further including a structural assembly for selectively adjusting the support frame between a stationary "use" mode condition and a movable "mobile" mode condition comprising: caster wheel support means connected to the lower portion of the support frame; axle mean pivotally mounted on the structural support means and including caster wheel means mounted thereon; leverage means pivotally mounted on the structural support means with a portion thereof in cooperative engagement with the pivotal axle mean; and, actuating means cooperative with the leverage and axle means to provide for movement of the axle means and the caster wheel means mounted thereon between the support frame "use" mode and the support frame "mobile" mode conditions. In addition, the present invention provides a novel support frame structural assembly which does not require the actuated leverage and axle arrangement aforedescribed, the novel structural assembly including a pair of aligned spaced uprights joined by transversely extending beams with caster wheel support means fixed to the lower portion of the transversely extending beams for the spaced uprights; and, caster wheel means yieldingly supported by the upright joining beans to adjustably and yieldably extend below the lower extremities of the pair of spaced uprights when the support frame is free of user-added weight in a "mobile" mode and to extend above the lower extremities of the spaced uprights when the support frame is in a user-added weight "use" mode. The present invention further provides unique arrangements for the caster wheel means to be held for movement in a preselected aligned position or to be rotatable in accordance with elected movement of the support frame.

It is to be understood that various changes can be made in one or more of the several parts of the inventive structural assembly arrangements described herein by one skilled in the art without departing from the scope or spirit of the present invention.

BRIEF DESCRIPTION OF THE DRAWINGS

Referring to the drawings, which disclosed embodiments of the present invention here employed with step ladder structure.

DETAILED DESCRIPTION OF THE INVENTION

Figure 1:
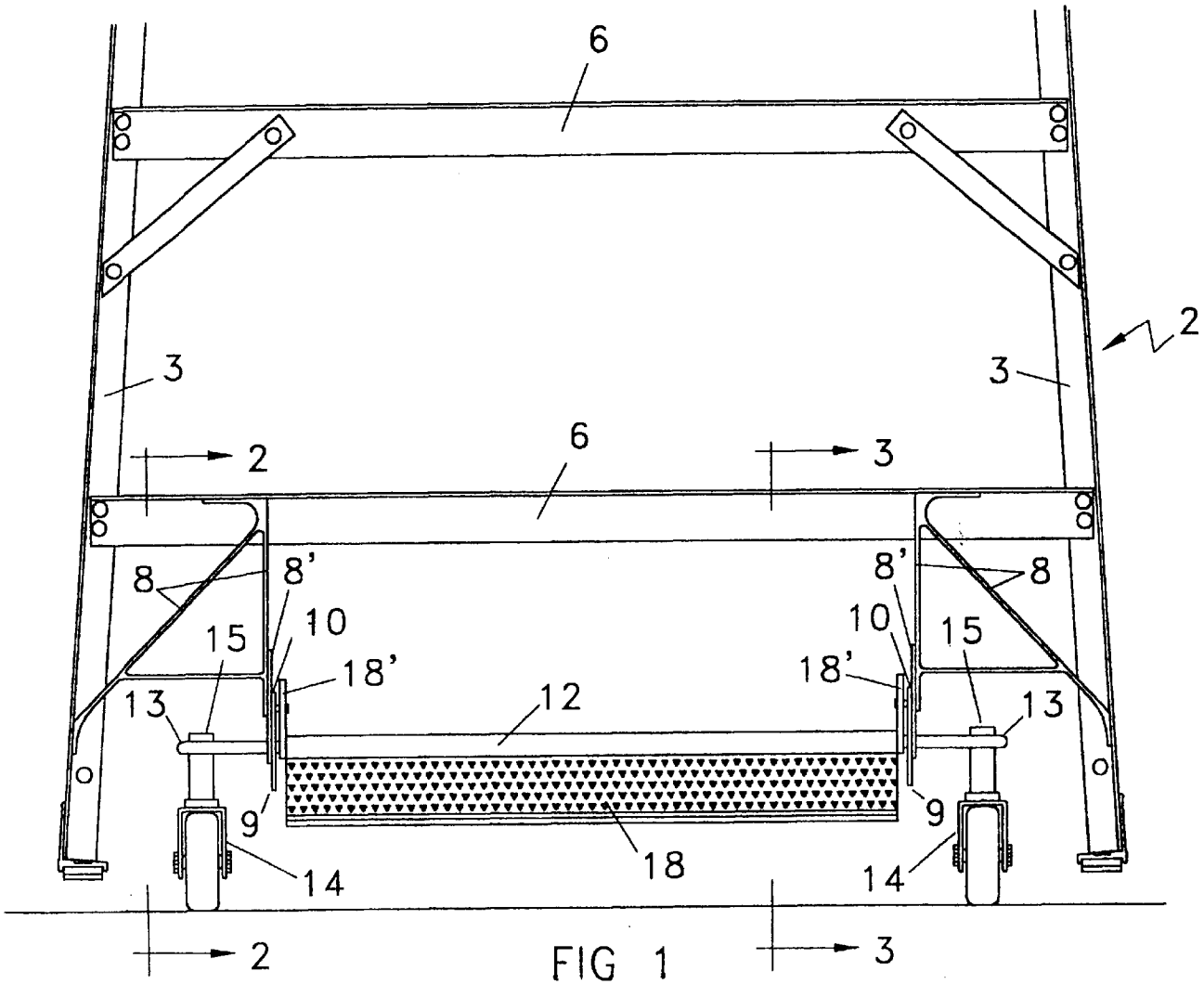
FIG. 1 is a broken view from inside the bottom of the lower portion of a step ladder looking outwardly, incorporating certain of the novel features of the present invention with the step ladder being shown in a "mobile" mode condition.

Referring to the drawings, it can be seen that the novel support fame assembly is here disclosed as part of a support frame structure in the form of a step ladder assembly 2 including aligned front (FIGS. 1–8) and rear pairs (FIGS.

9–12) of generally vertically extending spaced stringers 3 and 4, respectively. As known in the step ladder art, the stringer pairs 3 and 4 are collapsibly and extendably hinged together at their respective upper portions to include a support platform 10 (FIG. 9) with the first or front pair of stringers 3 having a plurality of suitably spaced horizontally extending steps 6. As is conventional, each step 6 is connected at the opposite ends thereof to the front stringers 3. As also is conventional, the aligned second or rear stringer pair 4 (FIG. 4) has transversely extending structural beams 7 (FIG. 9) connected at opposite ends to the spaced stringers. In this regard, and as will be more fully described hereinafter (FIGS. 9–12), at least one of the transversely extending and stringer connected beams is of cross-sectional U-shaped configuration to serve as part of one novel feature of the present invention.

Figure 3:
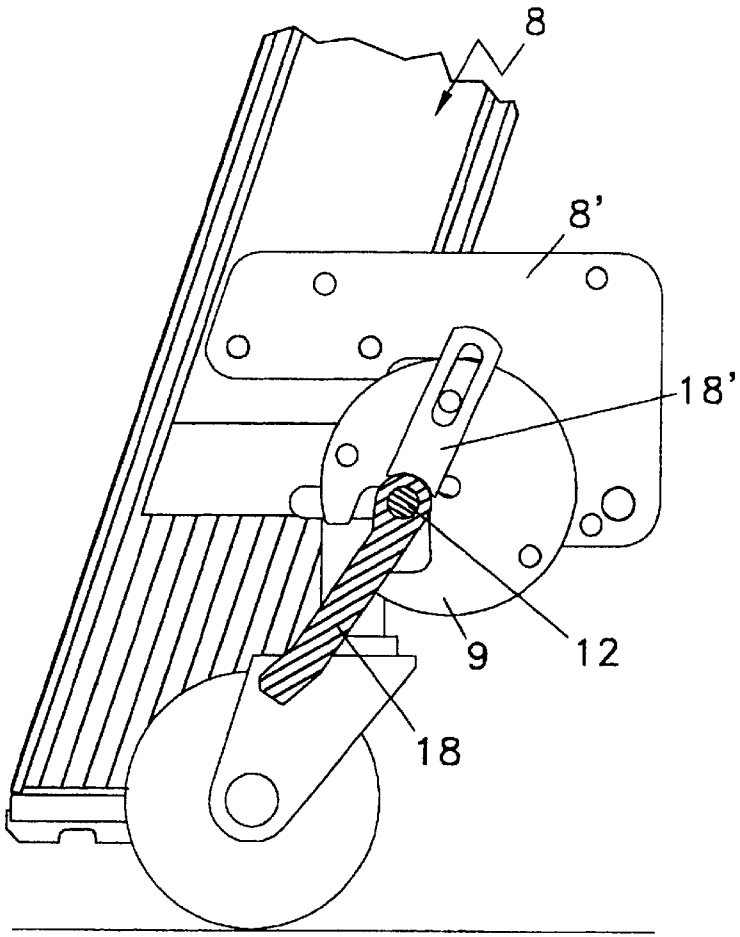
FIG. 3 is an enlarged cross-sectional side view similar to that of FIG. 1, taken in a plane through line 3—3 of FIG. 1, the step ladder being in a "mobile" mode condition.
Figure 2:
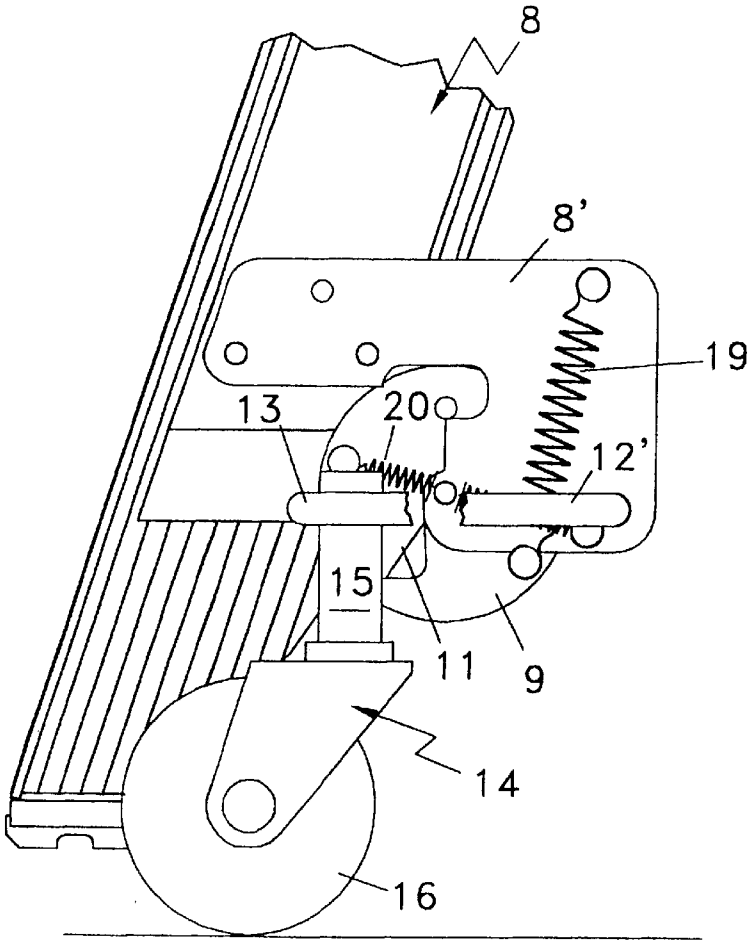
FIG. 2 is an enlarged cross-sectional side view of the front structure taken in a plane through line 2—2 of FIG. 1, the step ladder being shown in a "mobile" mode condition.
Figure 3A:
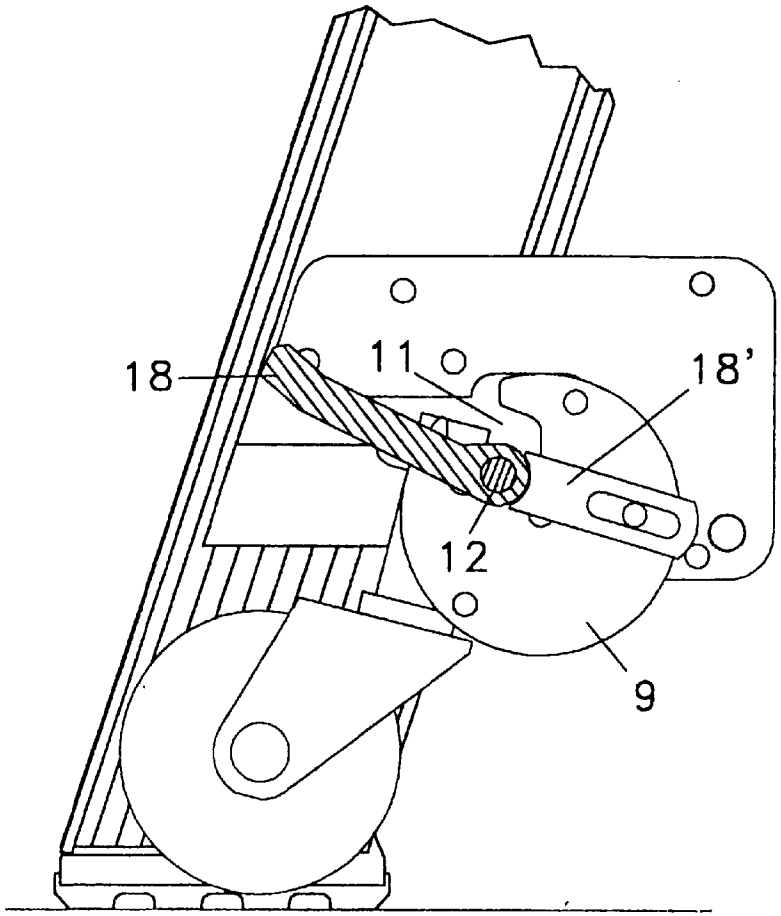
FIGS. 2A and 3A are views similar to FIGS. 2 and 3, respectively, with the step ladder being shown in a "use" condition.
Figure 2A:
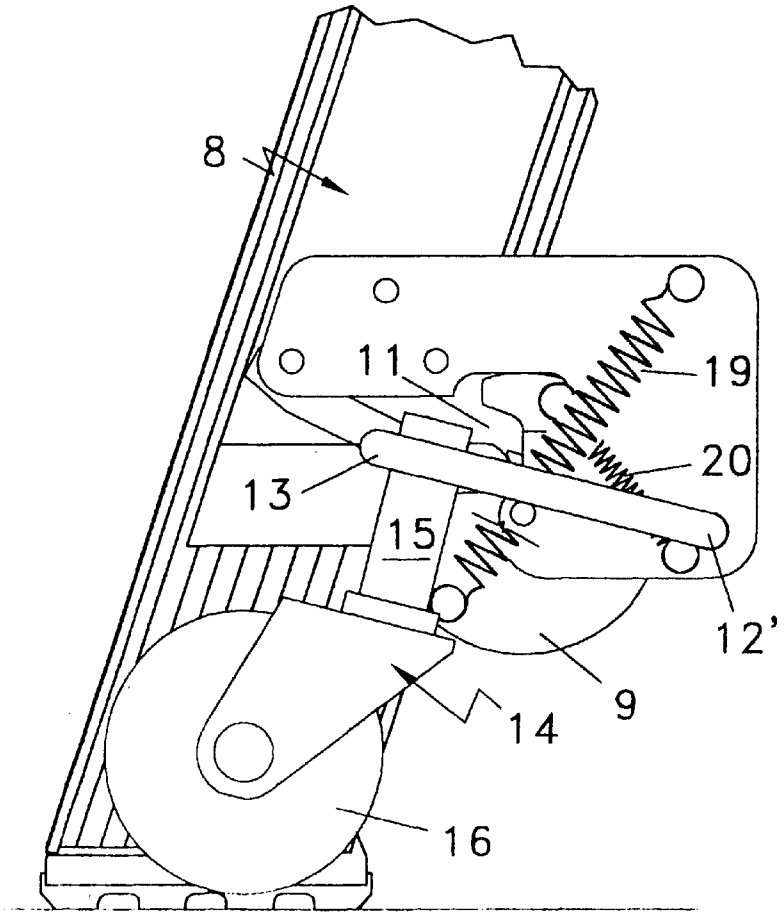
Figure 6:
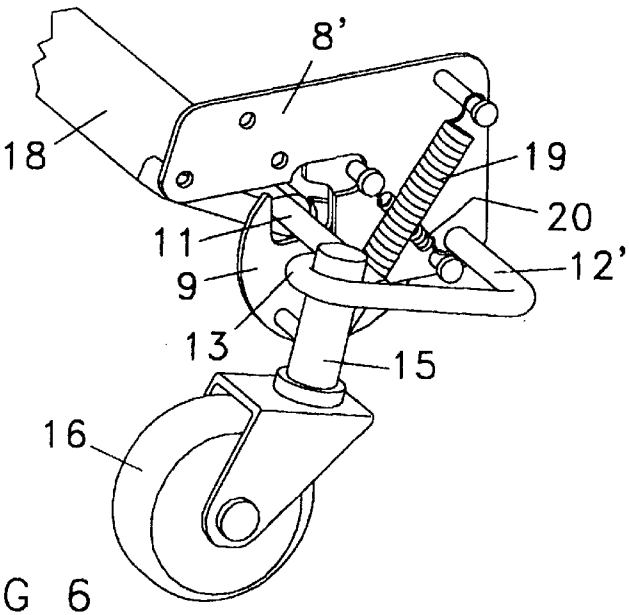
FIGS. 5 and 6 are broken, isometric views of structure similar to the structures of FIGS. 2 and 2A, respectively, disclosing such structures in "mobile" and "use" mode conditions, respectively.
Figure 5:
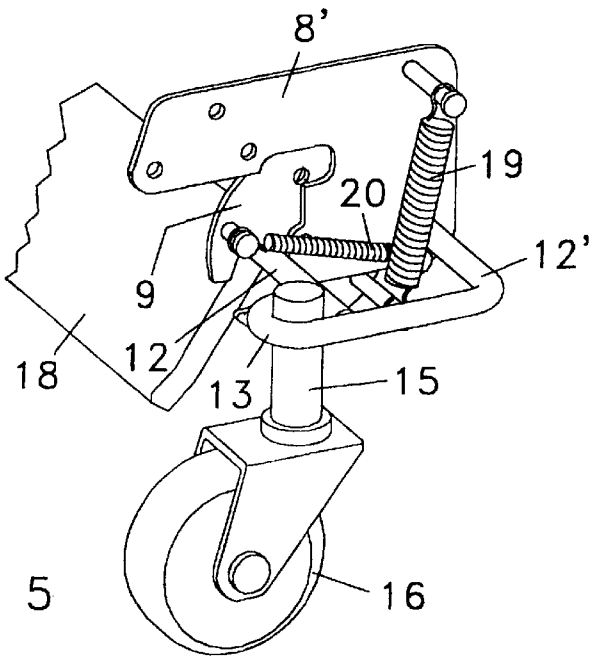
Figure 7:
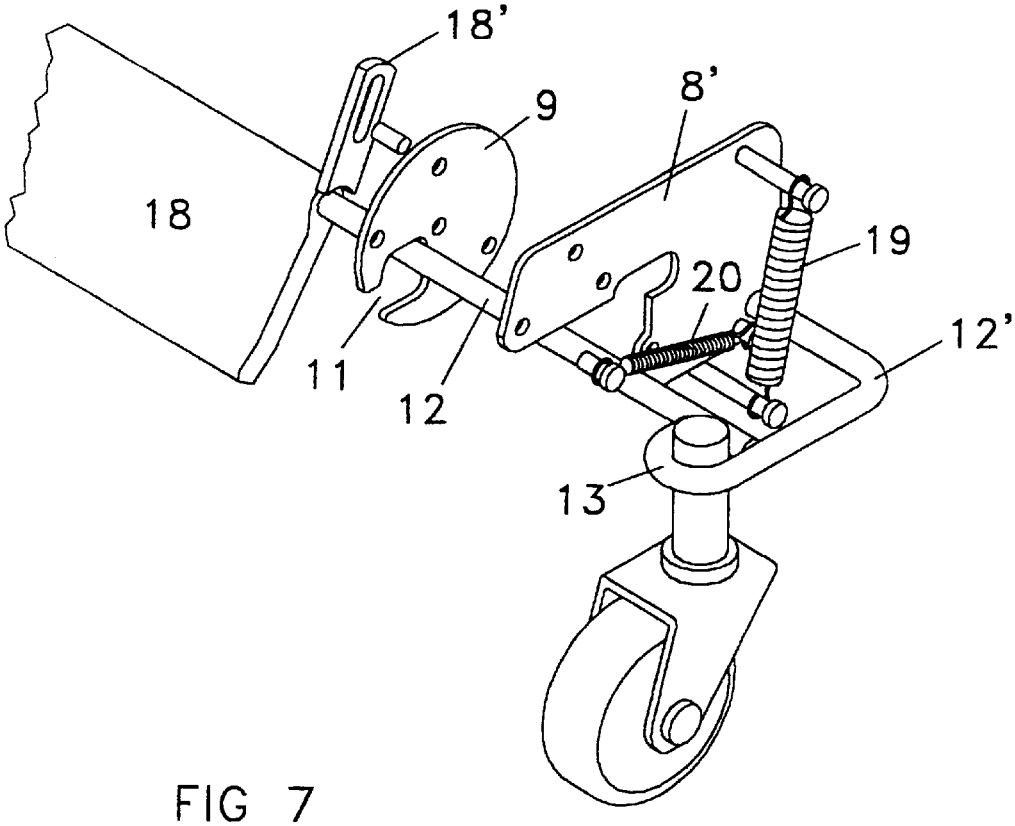
FIGS. 7 and 8 are broken, isometric views of structures such as disclosed in FIGS. 5 and 6 in "mobile" and "use" mode conditions, respectively.
Figure 8:
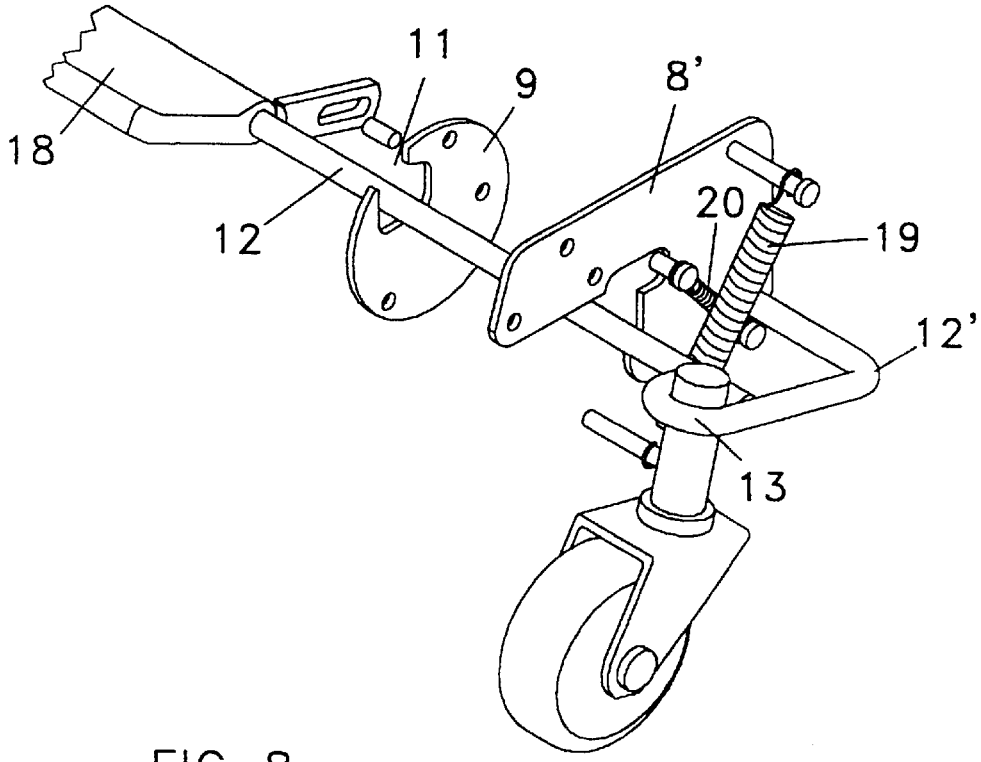

Referring to FIGS. 1–8 of the drawings, the first or front pair of stringers 3 has a first spaced pair of caster wheel structural support member assemblies 8, 8' fastened to the underface of the lowest of front steps 6, these caster wheel support member assemblies 8, 8' are in spaced relation to each other and each extends downwardly in fastened two-piece, 8 and substantially normal thereto 8' fashion, each assembly 8, 8' being adjacent and parallel to one of the stringers of the front spaced stringer pair 3. It is to be understood that 8 and 8' can be formed as one integral piece if so desired. Opposed and spaced, aligned rotary disk members 9 are rotatably mounted adjacent the distal end of each downwardly extending support member assembly 8, 8' with the peripheral surface of each rotary disk members 9 incorporating a selectively contoured and correspondingly aligned notch 11 (FIGS. 2, 3 and 6).

Figure 4:
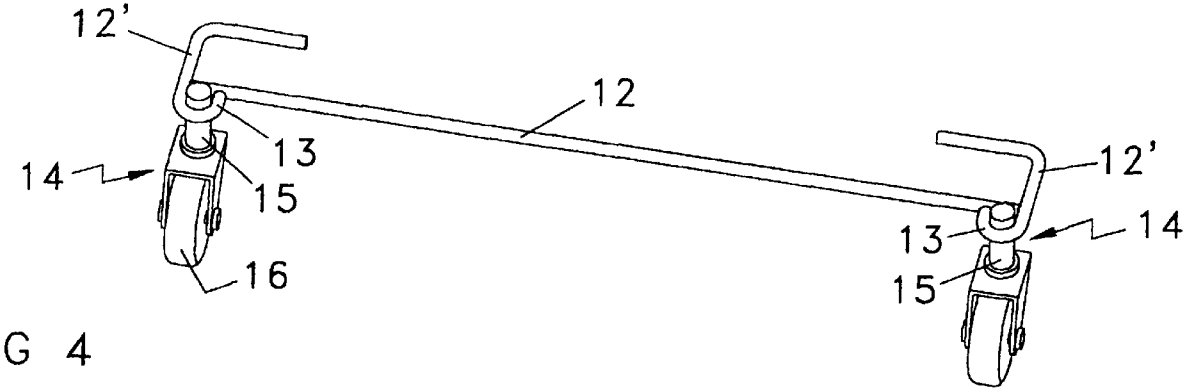
FIG. 4 is an isometric view of the caster frame assembly and caster wheel assembled therewith.

Also, rotatably mounted on and between the spaced, downwardly extending support members are the opposite extremities of a longitudinally extending caster wheel support axle 12 (FIGS. 1 and 4). Axle 12 terminates at its opposite extremities in U-shaped configurations with the opposed distal legs 12' of each extremity of axle 12 being rotatably mounted on an adjacent downwardly extending caster wheel support member 8'. The rotatably longitudinally extending portion of axle 12 freely nests in the correspondingly aligned notches 11 of the rotatably mounted rotary disk 9 (FIGS. 5–8). It is to be noted that each of the aforedescribed U-shaped configurations at the opposite extremities of rotatable axle 12 includes a stem housing 15 incorporating a stem (not shown) connected to caster wheel saddle 14 which supports caster wheel 16. Stem housing 15, in turn, engages and is fixed in receiving loop 13, which is part of the rotatably mounted and supported distal legs 12' of the U-shaped end extremities of rotatable axle 12.

To move each of the caster wheel saddles 14 and the associated caster wheels 16, a longitudinally extending actuating member, here discloses as foot pedal 18 is longitudinally recessed along the bottom portion thereof (FIGS. 1 and 5–8) to rotatably receive in nesting engagement the longitudinally extending central portion of axle 12 which extends between the spaced, aligned notched rotary disks 9. Opposite ends of axle 12 are positioned to each engagingly be received in notch 11 of each rotary disk 9 (FIGS. 7 and 8) and slotted links 18', each link being connected at one of the two ends of foot pedal 18, and each being connected at an opposite end to a rotary disk 9. Helical coil springs 19, (FIGS. 2, 2A, 5 and 6) are provided to extend between each of the downwardly extending caster wheel structural support members 8' and the notched rotatable disk members 9. It is to be understood that, if desired, foot pedal 18 may also be fixedly attached to rotary disk 9.

The opposed ends of each helical coil spring 19 are connected at preselected positions on each downwardly extending two-piece support assembly 8, 8' and the rotary disk member 9, respectively, so that ready, light pressure responsive movement of notched rotary disk 9 by the notch engaged axle 12, which can be initiated when foot pedal 18 is actuated, causes caster wheels 16 to be moved to a "mobile" mode. Helical coil springs 19 further serve to yieldably restrain the caster wheels when the structural assembly is moved by imposed "user" weight to a "use" mode. Advantageously helical coil springs 19 can be so positioned to obtain ideal balanced conditions, when the longitudinal axis of the spring (FIGS. 1, 2 and 5) is caused to pass over the rotation center of rotary disk 9 when the foot pedal 18 is actuated to ladder "mobile" mode and when the caster wheels 14 are moved to restrained ladder "use" mode by imposed user weight on the structural assembly. Auxiliary secondary springs 20 (FIG. 2) are provided to extend in fastened relation between each rotary disk 9 and assembly 8, 8'. These secondary spring 20 serve to further hold the caster wheel assembly when in "use" mode condition.

Figure 9:
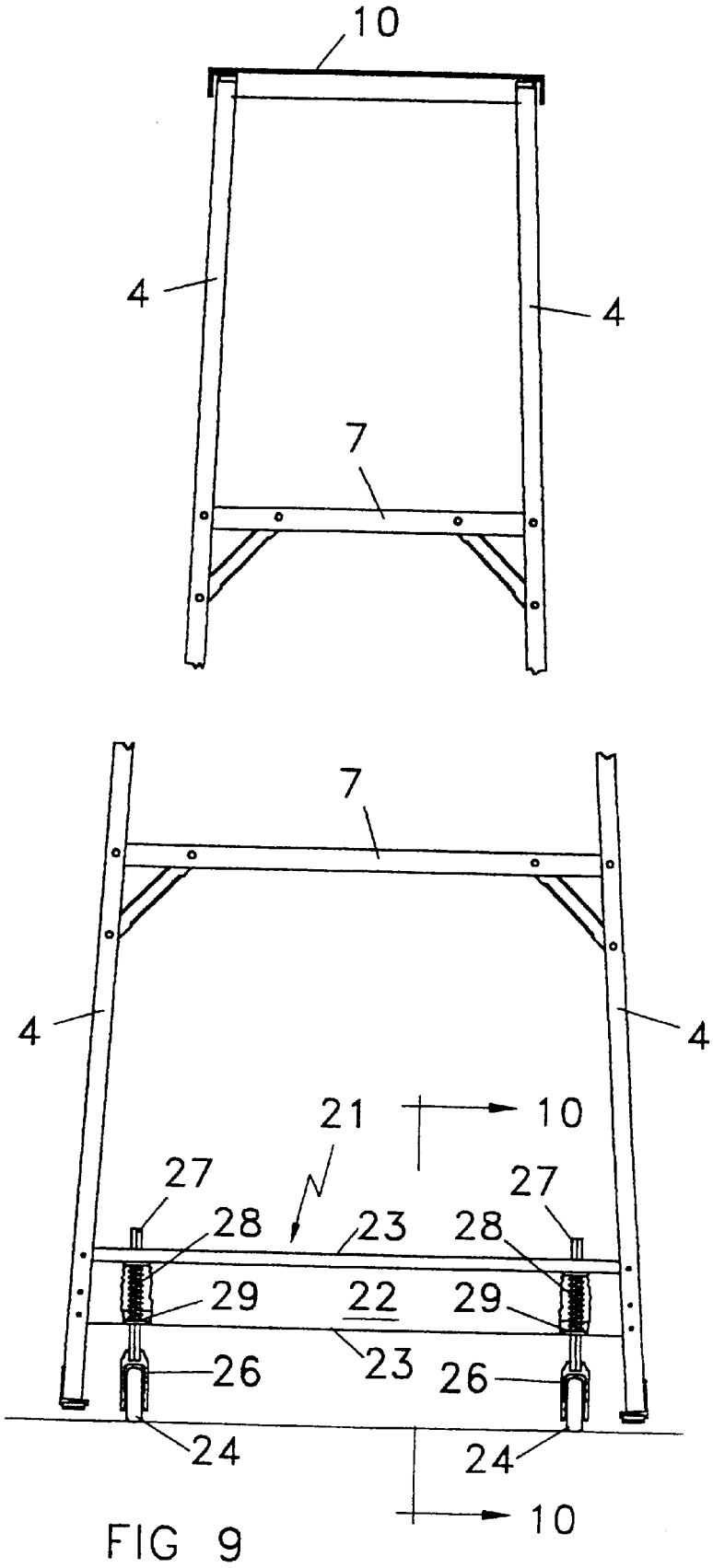
FIG. 9 is a broken rear view of the upper and lower portion of the ladder disclosing a still further novel concept of the invention independent of the actuating systems of FIGS. 1–3, 2A and 3A.
Figures 10, 11, 12:
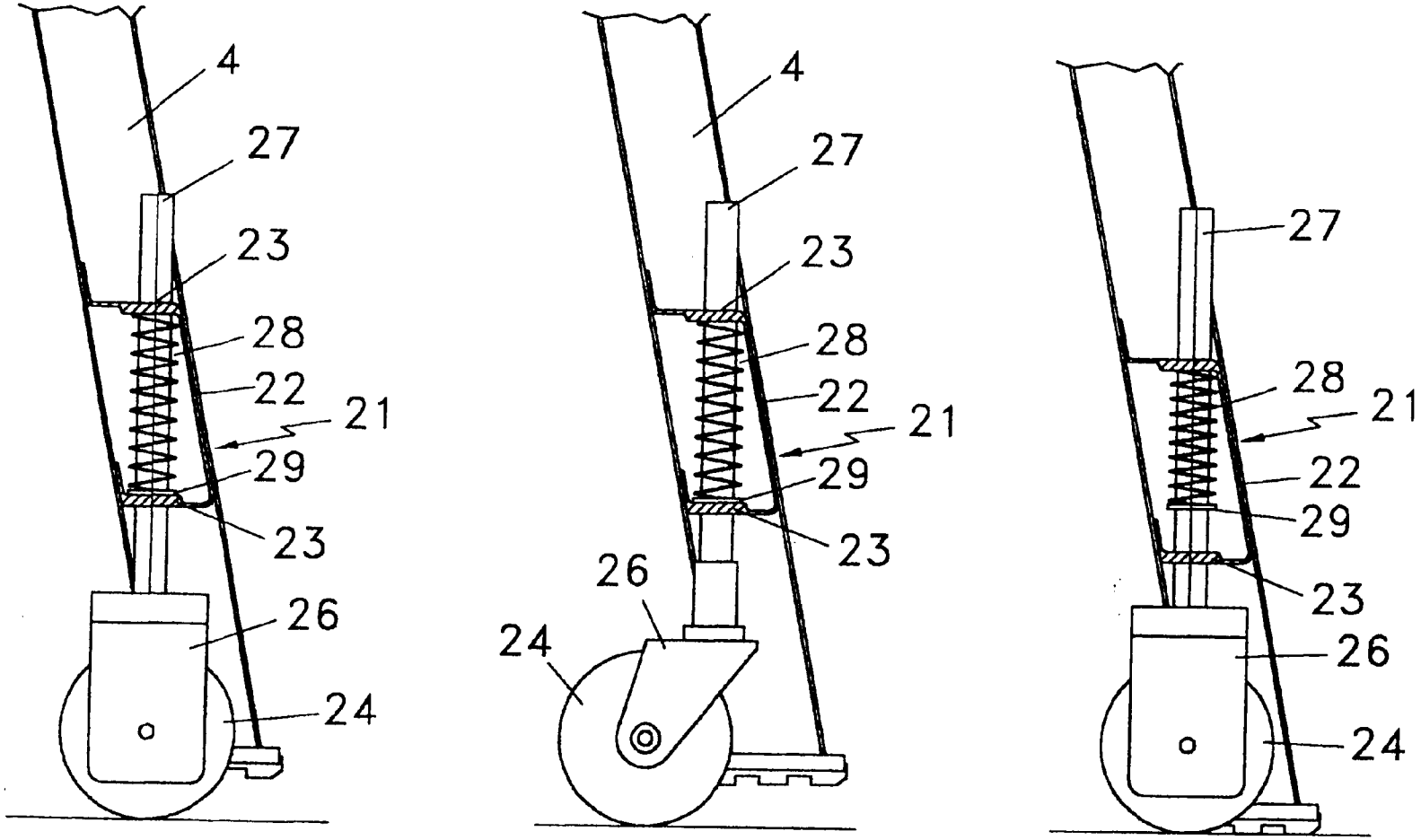
FIGS. 10 and 11 are enlarged cross-sectional side views of the rear support structure taken in a plane through line 10—10 of FIG. 9 with the structure in both views in weight removed "mobile" mode condition, the caster wheel stem of FIG. 10 having a multi-sided cross-section with a fixed stirrup so that the caster wheel moves in fast, preselected alignment and with the caster wheel stem of FIG. 11 having a circular cross-section and rotatable stirrup mounting so that the wheel rotates in response to support frame directional movement.
FIG. 12 is an enlarged cross-sectional side view similar to the fixed stirrup view of FIG. 10 with the support frame structure in weight applied "use" mode condition.

In accordance with still another feature of the present invention and as can be seen in FIGS. 9–12 of the drawings, the aforedescribed rear stringer pairs 4 disclosing the rear of support platform 10, can include at its lower portion a cross-sectionally U-shaped, horizontally and transversely extending support beam member 21 with the base leg portion 22 extending in a generally vertical plane and the spaced side legs 23 extending in generally horizontal planes. A set of caster wheels 24 are rotatably mounted on spaced, stemmed caster wheel frames 26 with the stems 27 thereof slidably projecting through aligned apertures in the horizontally extending spaced side legs 23. Each stem 27 is surrounded by a compressible helical coil spring 28 extending between spaced side legs 23. A stem mounted stop 29 is positioned at the lower extremity of each coil spring 28 so that spring 28 compresses when the ladder support frame is in a "use" condition above the lower extremities of the upright stringers (FIG. 12) and extends or expands when the ladder support frame is free of user imposed weight and the caster wheels 24 are urged below the lower extremities of the stringers to be in a "mobile" mode condition (FIGS. 10 and 11). As can be seen in FIGS. 10 and 12 of the drawings, each stem 27 is of multi-sided cross-section to engage with apertures in side legs 23 of similar multi-sided cross-section, allowing only fixed straight-line or "tracking" movement of rear casters 24. Alternatively, as can be seen in FIG. 11, each stem 27 can be of circular cross-section to engage with apertures in side legs 23 of similar circular cross-section with a bearing arrangement in caster frame 26, like the bearing arrangement of caster wheel housings 15, allowing free rotation of caster wheels 24.

In a typical operation of the inventive apparatus, to move a support platform, such as the step ladder disclosed, from a "use" mode condition to a "mobile" mode condition, it is only necessary that the "use" mode condition weight be removed and foot pedal 18 be lightly actuated. This causes slotted links 18' connected to pedal 18, to move notches 11 of rotary disks 11, which disks are rotatably mounted on 8', into engagement with the ends of axle 11. The light pressure exerted on pedal 18 and thus on the central body portion of axle 12, as well as the pressure exerted at the extremities of axle 12 by notches 11 of rotary disks 9, causes the caster wheels 14 supported by axle 12 to move below the feet of rails 3 against the forces of helical coil springs 19 and secondary holding spring 20 to place the caster wheel assembly into "mobile" mode condition with the rear caster wheels 24 also being in a "mobile" mode condition by removal of the "use" condition weight, the support platform can be readily moved to another location where "use" mode weight along with springs 19, 20 and 28 cause the caster wheel assembly to be raised and held in support platform "use" mode condition.

The invention claimed is:

1. In a support frame structural assembly including at least one pair of generally vertically extending spaced uprights connected by transversely extending cross-beam members, a structural support means for selectively adjusting said support frame between a stationary "use" mode and a movable "mobile" mode condition comprising: caster wheel support means connected to the lower portion of said structural support means; pivotal axle means pivotally mounted on said structural support means and including caster wheel means mounted on said pivotal axle means; leverage means pivotally mounted on said structural support means with a portion thereof in directly cooperative engagement with said pivotal axle means; actuating means cooperative with said leverage means and said pivotal axle means to provide for direct pivotal movement of said axle means and said caster wheel means mounted thereon between said support frame "use" mode and said support frame "mobile" mode conditions; and, yieldable restraining means including spring means to allow movement of said caster wheel means to a mobile mode condition and to yieldingly restrain said caster wheel means when in a "use" mode condition.

2. The support frame structural assembly of claim 1, said caster wheel support means being connected to the lower portion of said support frame below said transversely extending cross-beam members and between said pair of generally vertically extending spaced uprights.

3. The support frame structural assembly of claim 1, said caster wheel support means and said leverage means pivotally mounted on said structural means comprising spaced opposed support and notched rotary disk pairs with said notched rotary disk pairs engaging said axle means, said axle means comprising a longitudinally extending axle engaged by said spaced notched rotary disk pairs at opposite ends thereof.

4. The support fame structural assembly of claim 3, said yieldable restraining means including at least one helical coil spring member extending between said caster wheel support means connected to the lower portion of said structural support means and said rotary disk means with the opposed ends of said spring member connected at selected positions on said caster wheel support means and said rotary disk means respectively to permit ready pivotal movement of said rotary disk means and said axle means when said caster wheel means are actuated to a support frame "mobile" mode condition and to yieldingly restrain said caster wheel means when said support frame is moved to a "use" mode condition.

5. The support frame structural assembly of claim 1, said yieldable restraining means including auxiliary spring means to enhance restraint in said "use" mode condition.

6. The support frame structural assembly of claim 1, said leverage means including a recessed peripheral notch engageable with said pivotal axle means for movement by said leverage means when said leverage means is pivoted on said structural support means by said actuating means.

7. The support frame structural assembly of claim 1, said actuating means including a foot pedal mounted on said axle means.

8. The support frame structural assembly of claim 1, said pair of generally vertically extending spaced uprights comprising spaced, substantially parallel ladder stringers and said transversely extending cross-beam members comprising a set of spaced ladder steps extending between and connected to said stringers.

9. The support frame structural assembly of claim 1, said support frame including an aligned second pair of generally vertically extending spaced uprights connected by second transversely extending cross-beam members, said first and second pairs of aligned spaced uprights being connected to each other.

10. The support frame structural assembly of claim 9, said first and second pairs of aligned spaced uprights being connected to each other to include a support platform extending horizontally along the upper portions of said uprights.

11. The support frame structural assembly of claim 9, said second pair of aligned spaced uprights having caster wheel support means fixed to the lower portion thereof; and caster wheel means yielding supported thereby to adjustably and yieldably extend below the lower extremities of said second pair of spaced uprights when said support frame is free of user-imposed weight and in a "mobile" mode condition and to be above said lower extremities of said second pair of spaced uprights when said support frame is in a "user" mode condition.

12. The support frame structural assembly of claim 11, wherein said caster wheel support means comprises a U-shaped support beam with the spaced legs thereof extending in generally horizontal planes between the lower portion of said spaced uprights and with the base thereof extending in a generally vertical plane; and said caster wheel means comprises a set of spaced caster wheels rotatably mounted on spaced stemmed frames with the stems thereof slidably projecting through said horizontally extending spaced legs, each of said stems being surrounded by a compressible helical coil spring extending between said spaced legs and having a stem mounted stop at the lower extremity so that each spring compresses when said support frame is in an added weight "use" mode condition with said caster wheels positioned above the lower extremities of said upright legs and which spring extends when said support frame is in a "mobile" mode condition, with said caster wheels being spring urged below said lower extremities of said upright legs.

13. The support frame structural assembly of claim 12, said stems being rotatable along the longitudinal axes thereof.

14. The support frame structural assembly of claim 12, said stems being laterally fixed from rotation along the longitudinal axes thereof.

15. The support frame structural assembly spaced uprights connected together by opposite ends of transversely extending beam members at least one of which transversely extending beam members is cross-sectionally contoured to integrally incorporate a housing therein, stemmed caster wheel support means having the stem portion slidably disposed in said transverse extending beam member housing; and caster wheel means yielding supported by said caster wheel support means to adjustably and yieldably extend below the lower extremities of said pair of spaced uprights when said support frame is free of user-added weight and in a "mobile" mode condition and to be above said lower extremities of said spaced uprights when said support frame is in user-added weight "user" mode condition.

16. The support frame assembly of claim 15, said transversely extending beam member including a housing comprising a U-shaped support beam with the base portion extending in a generally vertical-plane and the spaced legs extending in generally horizontal planes to form said integral housing, and, said caster wheel means comprising a set of spaced, stemmed frames with the stems thereof slidably projecting through said horizontally extending spaced legs, each stem being surrounded by a compressible helical coil spring extending between said legs and having a stem mounted stop at the lower extremity so that each spring compresses when said support frame is in a user added weight "use" mode condition with said caster wheels positioned above the lower extremities of said upright legs and which spring extends when said support frame is free of user added weight and is in a "mobile" mode condition with said caster wheels being urged below said lower extremities of said upright legs.

17. The support frame of claim 16, said stems being rotatable along the longitudinal axes thereof.

18. The support frame of claim 16, said stems being fixed from rotation along the longitudinal axes thereof.

19. A step ladder assembly including aligned first and second pairs of generally vertically extending spaced stringers collapsibly and extendably hinged together at respective upper portions thereof, with said first pair of spaced stringer having a plurality of spaced, horizontally extending steps, each step being connected at opposite step ends to said first pair of spaced stringers and with said second pair of spaced stringers having transversely extending structural beams, each structural beam being connected at opposite beam ends to said second pair of spaced stringers; said first pair of spaced stringers having a first spaced pair of caster wheel structural support members extending therebetween and fastened to and extending downwardly from the lowest horizontally extending step supported on said first pair of spaced stringers; a pair of spaced, aligned rotary disk members, each pivotally mounted on one of said spaced downwardly extending caster wheel support members, said spaced rotary disk members including aligned spaced notches therein; a longitudinally extending rotatable caster wheel support axle terminating with opposite distal legs in U-shaped configurations, with the axle distal ends each rotatably mounted on an adjacent downwardly extending caster wheel support member with the rotatable longitudinally extending axle ends being engaged by correspondingly aligned notches of said pivotally mounted rotatable disk members, each of said U-shaped configurations of said rotatable caster wheel support axle at the opposite extremities of said rotatable support axle including a stem receiving loop opposite said rotatably mounted distal legs; a stemmed caster wheel housing including a rotatable caster wheel mounted at one extremity thereof and a stem at the opposite extremity nestingly fixed to one of each of said opposed loops; a longitudinally extending foot pedal mounted on the central portion of said longitudinally extending rotatable axle to extend between said spaced, aligned rotatable disk members; and helical coil springs extending between each of said caster wheel supports and said rotatable disk members with the opposed ends of each of said springs connected at selected positions on each of said caster wheel supports and said corresponding rotatable disk members to permit ready movement of each of said rotatable disks and said axle when said foot pedal actuates said caster wheels to a "mobile" mode condition and to yieldingly restrain said caster wheels when moved to a "use" mode condition.

20. The step ladder assembly of claim 19, said second pair of aligned stringers including a U-shaped support beam member with the base portion extending in a generally vertical plane and the spaced legs extending in generally horizontal planes; and a set of caster wheels rotatably mounted on spaced, stemmed frames with the stems thereof slidably projecting through said horizontally extending spaced legs, each stem being surrounded by a compressible helical coil spring extending between said legs and having a stem mounted stop so that each stop at the lower extremity spring compresses when said support frame is in a "use" mode condition with said caster wheels positioned above the lower extremities of said upright legs and which spring expands when said support frame is free of "user" imposed weight and is in a "mobile" mode condition with said caster wheels being urged below said lower extremities of said upright legs.

* * * * *

UNITED STATES PATENT AND TRADEMARK OFFICE

CERTIFICATE OF CORRECTION

PATENT NO. : 6,026,931

DATED : February 22, 2000

INVENTOR(S) : Paul R. Swiderski

It is certified that error appears in the above-identified patent and that said Letters Patent is hereby corrected as shown below:

Col. 6, line 51 replace "assembly spaced" with --assembly of claim 1, including a second pair of generally vertically extending spaced--.

Signed and Sealed this

Second Day of January, 2001

*Attest:*

*Attesting Officer*

Q. TODD DICKINSON

*Commissioner of Patents and Trademarks*

UNITED STATES PATENT AND TRADEMARK OFFICE

CERTIFICATE OF CORRECTION

PATENT NO. : 6,026,931
DATED : February 22, 2000
INVENTOR(S) : Paul R. Swiderski It is certified that error appears in the above-identified patent and that said Letters Patent is hereby corrected as shown below:

Drawings,
FIG. 1, delete reference numeral 10.

Column 1,
Line 49, replace "mean" with -- means --;
Line 53, replace "axle mean" with -- axle means --.

Column 2,
Line 16, replace "disclosed" with -- disclose --;
Line 65, replace "fame" with -- frame --.

Column 3,
Line 10, replace "FIG. 4" with -- FIG. 9 --;
Line 20, replace ", these" with --. These --;
Line 30, replace "members" with -- member --;
Line 53, replace "discloses" with -- disclosed --.

Column 4,
Line 16, replace "wheels 14" with -- wheels 16 --;
Line 20, replace "spring" with -- springs --;
Line 24, replace "pairs 4 disclosing" with -- pair 4 disposing --;
Line 59, replace "rotary disks 11" with -- rotary disks 9 --;
Line 60, replace "axle 11" with -- axle 12 --;
Line 64, replace "wheels 14" with -- wheels 16 --;
Line 66, replace "spring" with -- springs --.

Column 5,
Line 2, replace ", the" with -- . The --;
Line 25, replace "and," with -- and --;
Line 42, replace "fame" with -- frame --.

Column 6,
Lines 40, 43, and 44, replace "upright legs" with -- uprights --;

UNITED STATES PATENT AND TRADEMARK OFFICE

CERTIFICATE OF CORRECTION

PATENT NO. : 6,026,931
DATED : February 22, 2000
INVENTOR(S) : Paul R. Swiderski It is certified that error appears in the above-identified patent and that said Letters Patent is hereby corrected as shown below:

Column 7,
Line 24, replace "stringer" with -- stringers --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*